US009200840B2

(12) United States Patent
Choi et al.

(10) Patent No.: US 9,200,840 B2
(45) **Date of Patent: *Dec. 1, 2015**

(54) CLOTHES DRYER AND CONTROL METHOD THEREOF

(71) Applicant: Samsung Electronics Co., Ltd., Suwon-si (KR)

(72) Inventors: Hee Jung Choi, Seoul (KR); Geun Kang, Hwaseong-si (KR); Do Haeng Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 169 days.

This patent is subject to a terminal disclaimer.

(21) Appl. No.: 14/013,397

(22) Filed: Aug. 29, 2013

(65) Prior Publication Data

US 2013/0340276 A1 Dec. 26, 2013

Related U.S. Application Data

(63) Continuation of application No. 13/052,643, filed on Mar. 21, 2011, now Pat. No. 8,544,187.

(30) Foreign Application Priority Data

Apr. 30, 2010 (KR) ..... 10-2010-0040838

(51) Int. Cl.

| | |
|---|---|
| ***D06F 58/00*** | (2006.01) |
| ***F26B 21/06*** | (2006.01) |
| ***D06F 58/28*** | (2006.01) |

(52) U.S. Cl.

CPC ..... *F26B 21/06* (2013.01); *D06F 58/28* (2013.01); *D06F 2058/2809* (2013.01); *D06F 2058/289* (2013.01); *D06F 2058/2816* (2013.01); *D06F 2058/2896* (2013.01)

(58) Field of Classification Search

CPC ..... F26B 11/00; F26B 11/02; D06F 58/00; D06F 58/20

USPC ..... 34/499, 282, 572; 68/5 C, 5 R, 19, 20; 8/137, 149, 159

See application file for complete search history.

(56) References Cited

U.S. PATENT DOCUMENTS

| | | | |
|---|---|---|---|
| 3,210,862 | A | 10/1965 | Lycan |
| 6,381,870 | B1 | 5/2002 | Kohlman et al. |

(Continued)

FOREIGN PATENT DOCUMENTS

| | | |
|---|---|---|
| EP | 2241668 | 10/2010 |
| FR | 2612953 | 9/1988 |

(Continued)

OTHER PUBLICATIONS

Chinese Office Action dated Jun. 18, 2014 in corresponding Chinese Patent Application No. 201110105673.X.

(Continued)

*Primary Examiner* — Stephen M Gravini
(74) *Attorney, Agent, or Firm* — Staas & Halsey LLP

(57) ABSTRACT

Disclosed herein are a clothes dryer and a control method thereof in which a drying time is adjusted according to wool content during a drying cycle of a wool course. Wool content of woolen textiles is judged by sensing a dryness of the woolen textiles during a drying cycle of a wool course, and a drying time is adjusted according to the wool content, thereby minimizing contraction or deformation of the woolen textiles while satisfying the range of a target dryness set by wool mark standards. Further, only a high-capacity heater is driven during the drying cycle of the wool course, thereby allowing an internal temperature of a rotary drum to keep the optimum temperature without contraction or deformation of the woolen textiles.

5 Claims, 5 Drawing Sheets

(56) References Cited

U.S. PATENT DOCUMENTS

| | | | | |
|---|---|---|---|---|
| 6,931,760 | B2 | 8/2005 | Yang | |
| 7,059,065 | B2 | 6/2006 | Gerlach et al. | |
| 7,383,644 | B2 | 6/2008 | Lyu et al. | |
| 7,392,600 | B2 | 7/2008 | Gerlach et al. | |
| 7,475,495 | B2 | 1/2009 | Chiles et al. | |
| 7,735,239 | B2 | 6/2010 | Jeong et al. | |
| 7,921,578 | B2 | 4/2011 | McAllister et al. | |
| 8,544,187 | B2 * | 10/2013 | Choi et al. | 34/407 |
| 2002/0000049 | A1 | 1/2002 | Woerdehoff et al. | |
| 2002/0040504 | A1 | 4/2002 | DuVal et al. | |
| 2004/0200093 | A1 | 10/2004 | Wunderlin et al. | |
| 2005/0060811 | A1 | 3/2005 | Smith et al. | |
| 2005/0091876 | A1 * | 5/2005 | Yang | 34/491 |
| 2006/0191161 | A1 | 8/2006 | Wunderlin et al. | |
| 2006/0225302 | A1 | 10/2006 | Lyu et al. | |
| 2007/0169283 | A1 | 7/2007 | Kim et al. | |
| 2009/0044577 | A1 | 2/2009 | Lee | |
| 2009/0211108 | A1 | 8/2009 | Moschutz et al. | |
| 2009/0282695 | A1 | 11/2009 | Kreutzfeldt et al. | |
| 2011/0083338 | A1 | 4/2011 | Carow et al. | |
| 2011/0265343 | A1 | 11/2011 | Choi et al. | |
| 2011/0302967 | A1 | 12/2011 | Grunert et al. | |
| 2012/0056827 | A1 | 3/2012 | Kim et al. | |
| 2012/0096739 | A1 | 4/2012 | Clark | |
| 2013/0091726 | A1 | 4/2013 | Kim et al. | |

FOREIGN PATENT DOCUMENTS

| | | | |
|---|---|---|---|
| KR | 10-2009-0126138 | | 12/2009 |
| WO | WO0102639 | | 1/2001 |
| WO | 2007/137857 | A1 | 12/2007 |
| WO | 2009/148250 | A2 | 12/2009 |

OTHER PUBLICATIONS

European Search Report dated Sep. 19, 2011 issued in correspondence with European Patent Application No. 11159489.1.
US Office Action issued Apr. 18, 2013 in U.S. Appl. No. 13/052,643.
US Notice of Allowance issued May 29, 2013 in U.S. Appl. No. 13/052,643.
U.S. Appl. No. 13/052,643, filed Mar. 21, 2011, Hee Jung Choi, et al., Samsung Electronics Co., Ltd.

* cited by examiner

CLOTHES DRYER AND CONTROL METHOD THEREOF

CROSS-REFERENCE TO RELATED APPLICATIONS

This application is a Continuation of U.S. patent application Ser. No. 13/052,643, filed Mar. 21, 2011 which claims the benefit of Korean Patent Application No. 10-2010-0040838, filed on Apr. 30, 2010 in the Korean Intellectual Property Office, the disclosure of which is incorporated herein by reference.

BACKGROUND

1. Field

Embodiments relate to a clothes dryer and a control method thereof in which a drying time is adjusted according to wool content during a drying cycle of a wool course.

2. Description of the Related Art

In general, a clothes dryer is an apparatus which supplies hot air to a drum in which clothes to be dried are received so as to dry the clothes. Clothes dryers are basically classified into an exhausting type dryer in which high-temperature and high-humidity air having passed through a drum is exhausted to the outside of the dryer, and a condensing type dryer in which high-temperature and high-humidity air having passed through a drum is dehumidified and then is re-circulated into the drum.

A clothes dryer performs a drying cycle of a wool course to dry delicate woolen textiles. The drying cycle of the wool course is performed at a designated temperature (about 50 degrees) for a set time (about 4~5 minutes) in order to reduce damage to the woolen textiles, thereby minimizing contraction of the woolen textiles or deformation of the woolen textiles due to heat.

However, in spite of differences in moisture contents (soaking degrees in water) in woolen textiles according to wool contents thereof, the conventional wool course carries out a drying cycle for a set time without consideration of the moisture content in woolen textiles, and thereby the drying cycle may be completed in the wet state of the textiles before the textiles are completely dried. In this case, dryness (within about 6%) set by wool mark standards is not satisfied.

SUMMARY

Therefore, it is an aspect to provide a clothes dryer and a control method thereof in which a drying time is adjusted according to wool content during a drying cycle of a wool course so as to satisfy a range of dryness set by wool mark standards.

Additional aspects will be set forth in part in the description which follows and, in part, will be obvious from the description, or may be learned by practice of the embodiments.

In accordance with one aspect, a clothes dryer includes a drum to receive laundry to be dried, heaters to supply hot air to the inside of the drum, a dryness sensor to sense a dryness of the laundry, and a control unit to adjust a drying time of the laundry by judging wool content of the laundry according to the sensed dryness during a drying cycle of a wool course.

The clothes dryer may further include a motor to rotate the drum and to circulate the hot air, and the control unit may perform the drying cycle of the wool course by driving the heaters and the motor.

The heaters may include a high-capacity first heater and a low-capacity second heater, and the control unit may perform the drying cycle of the wool course by controlling the high-capacity first heater.

The dryness sensor may output a pulse value generated by converting the dryness of the laundry into an electrical signal while performing the drying cycle of the wool course.

The control unit may calculate the sum of pulse values for a designated time, compare the calculated sum of the pulse values with a set value, and adjust the drying time based on a result of the comparison.

The control unit, if the calculated sum of the pulse values is not more than the set value, may perform the drying cycle of the wool course for an initially set drying time.

The control unit, if the calculated sum of the pulse values is more than the set value, may perform the drying cycle of the wool course for an increased time obtained by adding a heater driving time to the initially set drying time.

The designated time may be a second time before a first time from start of the drying cycle of the wool course has elapsed.

The first time may be about 10 minutes.

The second time may be about 5 minutes.

In accordance with another aspect, a control method of a clothes dryer which has a drum to receive laundry to be dried, and heaters to supply hot air to the inside of the drum, includes judging whether or not a drying cycle of a wool course is selected, sensing a dryness of the laundry, if the drying cycle of the wool course is selected, and adjusting a drying time of the laundry by judging wool content of the laundry according to the sensed dryness.

In the sensing of the dryness of the laundry, the dryness of the laundry may be sensed using a pulse value generated by converting the dryness of the laundry into an electrical signal while performing the drying cycle of the wool course.

In the adjustment of the drying time, the sum of pulse values for a designated time may be calculated, and if the calculated sum of the pulse values is not more than a set value, the drying cycle of the wool course may be performed for an initially set drying time.

In the adjustment of the drying time, the sum of pulse values for a designated time may be calculated, and if the calculated sum of the pulse values is more than a set value, the drying cycle of the wool course may be performed for an increased time obtained by adding a heater driving time to an initially set drying time.

In the adjustment of the drying time, the drying cycle of the wool course may be performed by varying the heater driving time according to the calculated sum of the pulse values.

BRIEF DESCRIPTION OF THE DRAWINGS

These and/or other aspects of the embodiments will become apparent and more readily appreciated from the following description of the embodiments, taken in conjunction with the accompanying drawings of which.

DETAILED DESCRIPTION

Figure 1:
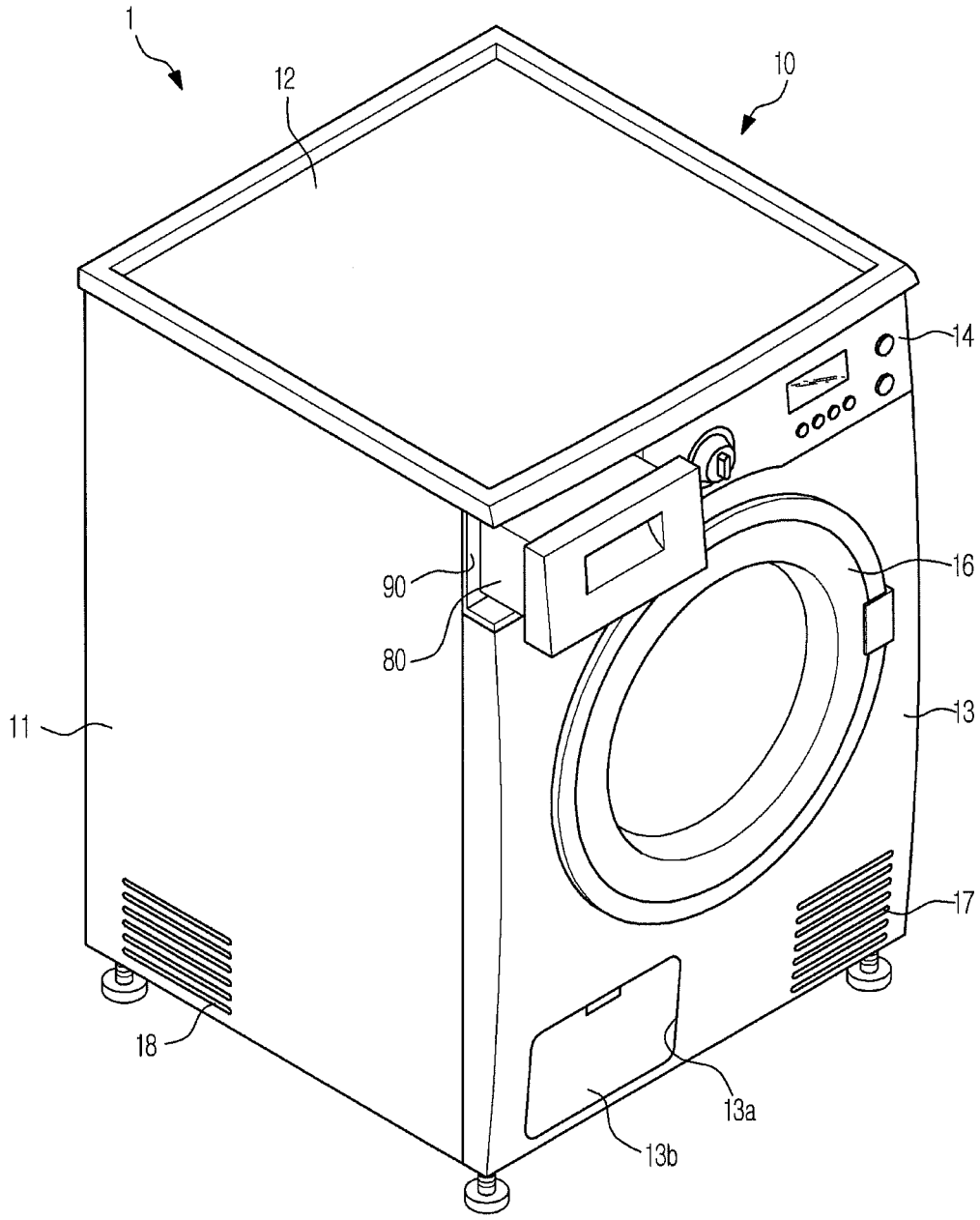
FIG. 1 is a perspective view illustrating an external appearance of a clothes dryer in accordance with one embodiment.

Reference will now be made in detail to the embodiments, examples of which are illustrated in the accompanying drawings, wherein like reference numerals refer to like elements throughout.

Figure 2:
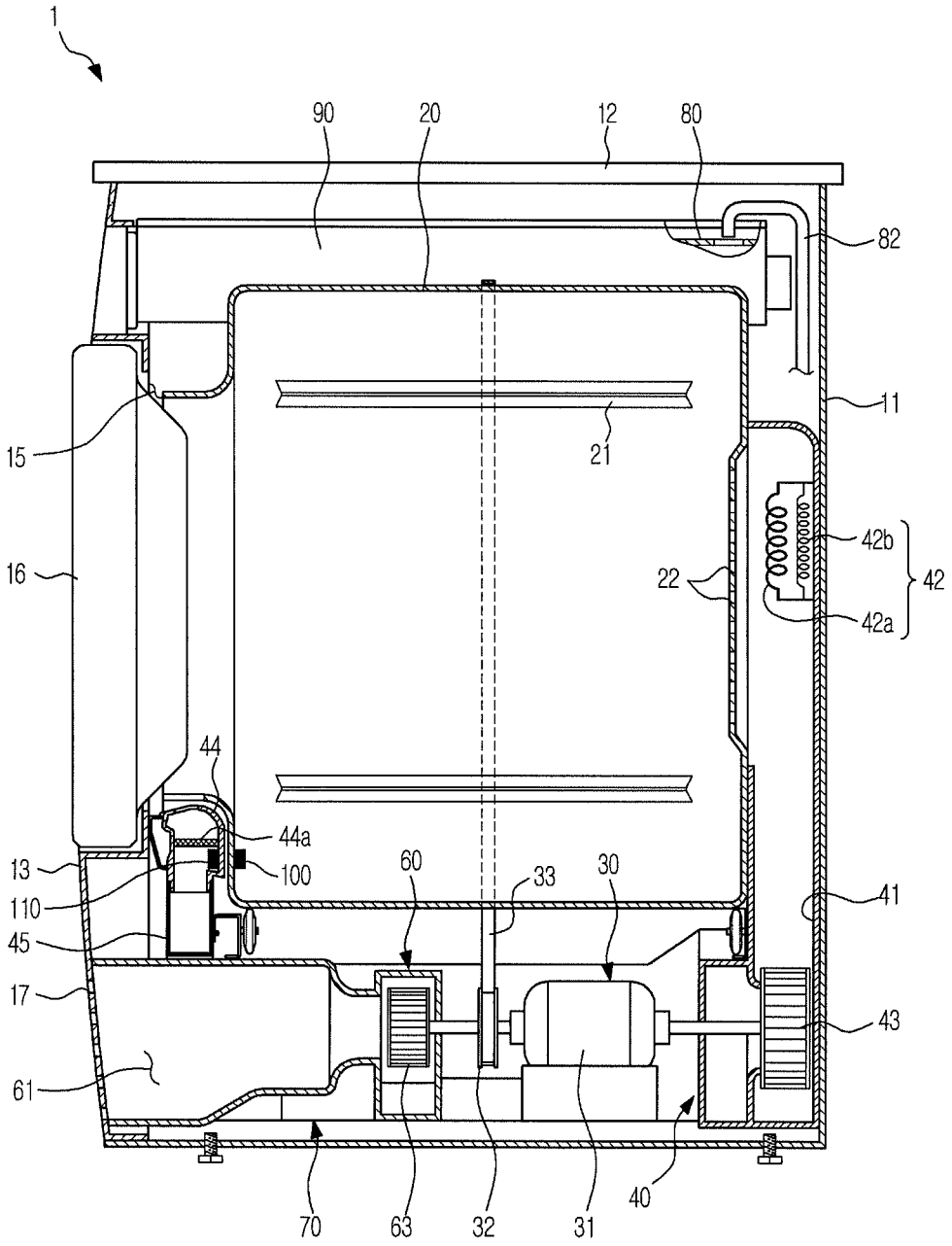
FIG. 2 is a longitudinal-sectional view illustrating a constitution of the clothes dryer in accordance with the embodiment.
Figure 3:
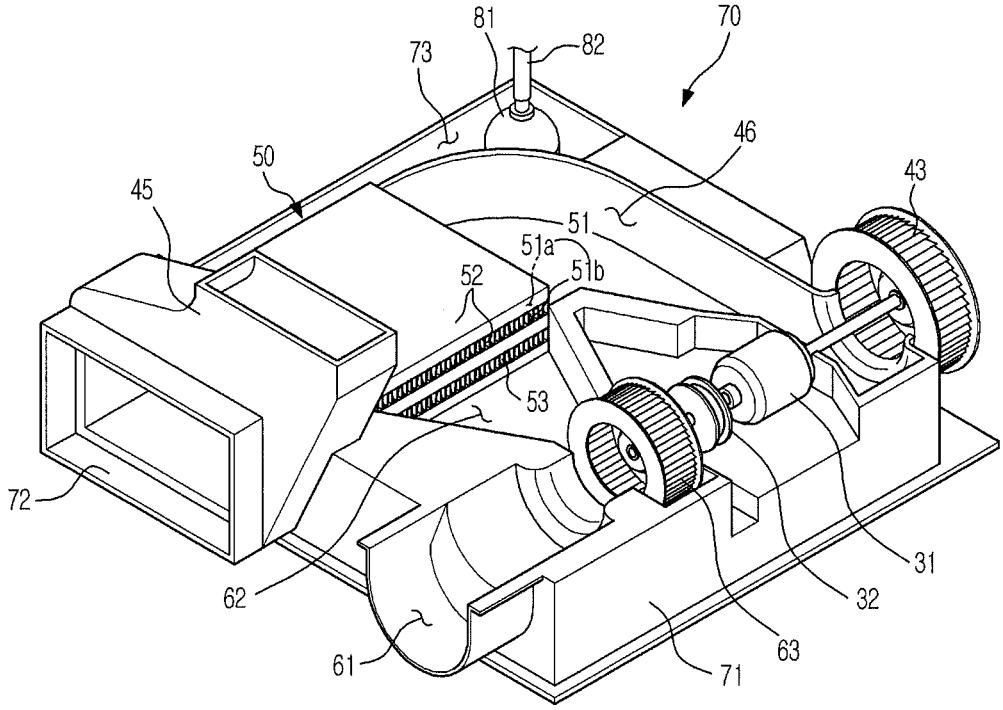
FIG. 3 is a detailed view illustrating a base assembly of the clothes dryer in accordance with the embodiment.

FIG. 1 is a perspective view illustrating an external appearance of a clothes dryer in accordance with one embodiment, FIG. 2 is a longitudinal-sectional view illustrating a constitution of the clothes dryer in accordance with the embodiment, and FIG. 3 is a detailed view illustrating a base assembly of the clothes dryer in accordance with the embodiment.

As shown in FIGS. 1 to 3, a clothes dryer 1 in accordance with one embodiment may include a main body 10, a rotary drum 20, a driving unit 30, a drying unit 40, a condenser 50, a cooling unit 60, and a water tank 80.

The main body 10 includes a cabinet 11, a top cover 12 covering the upper portion of the cabinet 1, a front panel 13 disposed on the front surface of the cabinet 1, a water tank housing 90 to receive the water tank 80, and a control panel 14 on which various buttons to control the clothes dryer 1 and a display are disposed. Although this embodiment illustrates an example in which the water tank housing 90 and the control panel 14 are integrated by a single frame, the water tank housing 90 and the control panel 14 may be provided separately from each other.

An inlet 15 through which clothes to be dried are put into the rotary drum 20 is formed through the front surface of the main body 10, and a door 16 to open and close the inlet 15 is hinged to the front surface of the inlet 15.

The rotary drum 20 is rotatably installed in the main body 10. A plurality of lifters 21 is disposed in the circumferential direction of the rotary drum 20 on the inner surface of the rotary drum 20. The lifters 21 elevate and drop the clothes, thereby enabling the clothes to be effectively dried.

The front surface of the rotary drum 20 is opened, and hot air introduction holes 22 are formed through the rear surface of the rotary drum 20. Air heated by the drying unit 40 is introduced into the rotary drum 20 through the hot air introduction holes 22.

A base assembly 70 is mounted below the rotary drum 20 (with reference to FIGS. 2 and 3). The base assembly 70 includes a base 71 on which channels 46, 61, and 62 are formed, and at least one base cover (not shown) to cover the base 71. The at least one base cover (not shown) covers upper portions of the condenser 50, a cooling fan 63, and the channels 46, 61, and 62, thereby forming a duct structure together with the base 71.

The rotary drum 20 is driven by the driving unit 30 (with reference to FIGS. 2 and 3). The driving unit 30 includes a motor 31 mounted on the base assembly 70, a pulley 32 rotated by the motor 31, and a belt 33 connecting the pulley 32 and the rotary drum 20 to transmit driving force of the motor 31 to the rotary drum 20.

The drying unit 40 heats air, and circulates the heated air to dry the clothes in the rotary drum 20. The drying unit 40 includes a heating duct 41, heaters 42, a circulation fan 43, a hot air discharge duct 44, a connection duct 45, and a hot air circulation channel 46.

The heating duct 41 is disposed in the rear of the rotary drum 20, and is communicated with the inside of the rotary drum 20 through the hot air introduction holes 22 formed through the rotary drum 20. Further, the heating duct 41 is communicated with the hot air circulation channel 46.

The heaters 42 and the circulation fan 43 are disposed in the heating duct 41. The heaters 42 heat air, and the circulation fan 43 sucks air in the hot air circulation channel 46 and then discharges the sucked air to the inside of the heating duct 41 so as to generate a circulating air current passing through the rotary drum 20.

The heaters 42 include first and second heaters 42*a* and 42*b* having different power capacities. The first heater 42*a* is a heater having a high capacity (for example, 1,750 W) to supply hot air of a high flow rate, and the second heater 42*b* is a heater having a low capacity (for example, 750 W) to supply hot air of a low flow rate. Although this embodiment illustrates the power capacity of the first heater 42*a* and the power capacity of the second heater 42*b* as being in the ratio of 7:3, the first heater 42*a* and the second heater 42*b* may be provided in various power capacity ratios to satisfy the optimum divisional condition to minimize contraction of textiles or deformation of the textiles due to heat while assuring drying performance. It is also understood that the heaters may include more than two heaters.

The circulation fan 43 may be driven by the motor 31 driving the rotary drum 20.

The hot air discharge duct 44 is disposed in front of the rotary drum 20, and guides discharge of high-temperature and high-humidity air having passed through the inside of the rotary drum 20. A filter 44*a* to filter out foreign substances, such as lint, from the air is installed in the hot air discharge duct 44.

The connection duct 45 connects the hot air discharge duct 44 and the hot air circulation channel 46, and the hot air circulation channel 46 connects the connection duct 45 and the heating duct 41 to circulate hot air. The connection duct 45 and the hot air circulation channel 46 may be integrated with the base assembly 70 (with reference to FIG. 3).

The condenser 50 to remove moisture from the circulating hot air is disposed in the hot air circulation channel 46. The hot air passing through the condenser 50 is cooled by relatively cool air supplied from the cooling unit 60, and thereby moisture contained in the circulating hot air is condensed.

The cooling unit 60 includes a suction channel 61, a discharge channel 62, and the cooling fan 63. One side of the suction channel 61 is connected to suction holes 17 (with reference to FIG. 1) formed through the lower portion of the front surface of the main body 10, and the other side of the suction channel 61 is connected to a suction side of the cooling fan 63. One side of the discharge channel 62 is connected to a discharge side of the cooling fan 63. The discharge channel 62 is extended toward the hot air circulation channel 46, and the condenser 50 is disposed at a point where the discharge channel 62 and the hot air circulation channel 46 meet. The suction channel 61 and the discharge channel 62 may be integrated with the base assembly 70 (with reference to FIG. 3).

The condenser 50 exchanges heat between hot air circulating through the hot air circulation channel 46 of the drying unit 40 and cool air flowing along the discharge channel 62 of the cooling unit 60 under the condition that the hot air and the cool air are isolated from each other. For this purpose, the condenser 50 includes a plurality of diaphragms 52 stacked at regular intervals to form heat exchange channels 51.

The heat exchange channels 51 include condensation channels 51*a* communicated with the connection duct 45 and the hot air circulation channel 46 to pass the circulating hot air, and cooling channels 51*b* communicated with the discharge channel 62 to pass the cool air. The condensation channels 51*a* and the cooling channels 51*b* are isolated from each other, have directionalities crossing each other, and are disposed alternately. Fin structures 53 to improve a heat-exchanging efficiency of the condenser 50 may be installed in the cooling channels 51*b*.

The condenser 50 is mounted on the base assembly 70 or is separated from the base assembly 70 through a condenser inlet 52 formed at one side of the front surface of the base assembly 70 and a condenser inlet 13*a* (with reference to FIG. 1) formed on the lower portion of the front panel 13 corresponding to the condenser inlet 72. The condenser inlet 13*a* of the front panel 13 is opened and closed by a cover 13*b* (with reference to FIG. 1).

A dryness sensor 100 to sense a dryness of clothes is installed in front of the rotary drum 20 provided with the hot air discharge duct 44. The dryness sensor 100 may be a touch sensor which contacts clothes to be dried (for example, woolen textiles) rotated according to rotation of the rotary drum 20, converts an electrical signal generated according to an amount of moisture contained in the clothes into a pulse signal, and outputs the pulse signal. However, it is understood that the dryness sensor may be any one other type of sensor than a touch sensor.

A temperature sensor 110 to sense a temperature of air within the rotary drum 20 in which the clothes are dried is installed in the hot air discharge duct 44.

When a drying cycle is started, the motor 31 and the heaters 42 are operated. The circulation fan 43 is rotated by the motor 31 to generate an air flow, and the heaters 42 heat air passing through the heating duct 41. The air heated in the heating duct 41 is introduced into the rotary drum 20 through the hot air introduction holes 22, and removes moisture from the clothes placed in the rotary drum 20, thereby drying the clothes. High-temperature and high-humidity air in the rotary drum 20 is guided to the condenser 50 through the hot air discharge duct 44 and the connection duct 45. The air guided to the condenser 50 is cooled and dehumidified while passing through the condensation channels 51*a* of the condenser 50, and is guided to the heating duct 41 through the hot air circulation channel 46. The circulated air is re-heated by the heaters 42, and then is supplied to the rotary drum 20.

The driving force of the motor 31 is transmitted to the rotary drum 20 through the belt 33, thus rotating the rotary drum 20. Thereby, the clothes in the rotary drum 20 are tumbled so as to be uniformly dried.

Further, the motor 31 rotates the cooling fan 63. When the cooling fan 63 is rotated, outdoor air is sucked into the main body 10 through the suction holes 17, and is guided to the condenser 50 through the channels 61 and 62 formed on the base assembly 70. The relatively cool air guided to the condenser 50 cools hot air passing through the condensation channels 51*a* of the condenser 50 while passing through the cooling channels 51*b* of the condenser 50, and then is discharged to the outside through discharge holes 18 (with reference to FIG. 1) formed through the main body 10.

Condensation water generated from the above drying process is collected in a condensation water collector 73 provided on the base assembly 70, as shown in FIG. 3. The condensation water in the condensation water collector 73 is pumped out by a condensation water pump 81, is guided to the water tank 80 by a condensation water discharge pipe 82, and is stored in the water tank 80.

Although the embodiment employs a condensing type dryer as the clothes dryer, an exhausting type dryer may be employed as the clothes dryer.

Figure 4:
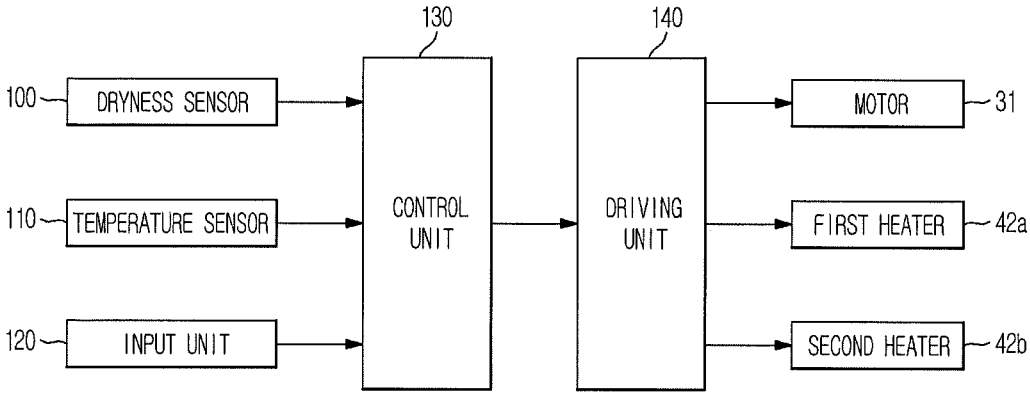
FIG. 4 is a control block diagram of the clothes dryer in accordance with the embodiment.

FIG. 4 is a control block diagram of the clothes dryer in accordance with the embodiment. The clothes dryer in accordance with the embodiment includes the dryness sensor 100, the temperature sensor 110, an input unit 120, a control unit 130, and a driving unit 140.

The dryness sensor 100 senses a dryness of clothes to be dried (for example, woolen textiles) using a pulse signal generated due to, for example, contact with the clothes, and outputs the sensed dryness to the control unit 130.

The temperature sensor 110 senses a temperature of air within the rotary drum 20 in which the clothes to be dried are received, i.e., an internal temperature of the rotary drum 20, and outputs the sensed internal temperature to the control unit 130.

The input unit 120 enables a user to input operation data selected by the user, including a drying course (for example, a wool course), a drying time and operation instructions, to the control unit 130.

The control unit 130 is a microcomputer to control overall operations of the clothes dryer 1 according to the operation data input from the input unit 120. During a drying cycle of a wool course, the control unit 130 senses a dryness of woolen textiles using the dryness sensor 100, judging wool content of the woolen textiles according to the dryness of the woolen textiles, and adjusts the drying time of the drying cycle based on the wool content.

In more detail, when the drying cycle of the wool course is started to be performed for a drying time (26 minutes) initially set, a dryness of woolen textiles is sensed using the dryness sensor 100 while performing the drying cycle. When a first time (about 10 minutes) from the start of the drying cycle has elapsed, the dryness sensor 100 calculates the sum of pulse values generated by converting the dryness of the woolen textiles into electrical signals for a second time (about 5 minutes) just before the first time (about 10 minutes) has elapsed, and then outputs the calculated sum of the pulse values to the control unit 130 according to the embodiment. However, the drying time, a first time, and a second time, may vary.

If the calculated sum of the pulse values is not more than a set value (for example, 15), the control unit 130 judges that the woolen textiles have a low wool content, and thus performs the drying cycle for the initially set drying time (26 minutes). Here, after 26 minutes from the start of the drying cycle has been elapsed, the heater is turned off, cooling is performed for 1 minute, and then the drying cycle is completed. Therefore, a total of 27 minutes is required.

On the other hand, if the calculated sum of the pulse values is more than the set value (for example, 15), the control unit 130 judges that the woolen textiles have a high wool content, and thus performs the drying cycle for a time obtained by adding a heater driving time (about 17 minutes) to the initially set drying time (26 minutes; a heater driving time obtained by subtracting the cooling time of 1 minute from the total of 27 minutes). That is, after 42 minutes from the start of the drying cycle has been elapsed, the heater is turned off, cooling is performed for 1 minute, and then the drying cycle is completed. Therefore, a total of 43 minutes is required.

Further, if the calculated sum of the pulse values is more than the set value (for example, 15), the control unit 130 may perform the drying cycle by varying the heater driving time added to the initially set drying time at intervals of a regular time (for example, 2~3 minutes) according to the sum of the pulse values.

For example, if the heater driving time is increased at intervals of 2 (3) minutes, the drying cycle is performed for 28 (29) minutes, 30 (32) minutes, 32 (35) minutes, . . . obtained by varying the heater driving time added to the initially set drying time at intervals of 2 (3) minutes according to the sum of the pulse values. In this case, a contraction rate of the woolen textiles is proportional to the drying time, and thus the total drying time of the drying cycle is designed so as not to exceed 43 minutes, for example.

As described above, the control unit 130 judges wool content according to a dryness of woolen textiles, and adjusts the drying time (the heater driving time) based on the wool content, thereby controlling the drying cycle of the woolen textiles to minimize contraction of the woolen textiles or deformation of the woolen textiles due to heat while satisfying the range of a target dryness (within about 6%) set by wool mark standards.

Further, the control unit 130 operates only the high-capacity first heater 42*a* during the drying cycle of the wool course, and thus controls the internal temperature of the rotary drum 20 to keep a regular temperature range (the optimum temperature range to prevent contraction or deformation of woolen textiles, about 50~52 degrees). The reason for operation of only the high-capacity first heater 42*a* during the drying cycle of the wool course is to prevent increase of the drying time while maintaining the optimum temperature range (about 50~52 degrees) within the rotary drum 20, because the contraction rate of woolen textiles is proportional to the drying time. However, it is not limited thereof.

In more detail, the control unit 130 switches the first heater 42*a* off when the internal temperature of the rotary drum 20 exceeds a second temperature (about 52 degrees), and switches the first heater 52*a* on when the internal temperature of the rotary drum 20 is less than a first temperature (about 50 degrees), thereby enabling the internal temperature of the rotary drum 20 to keep a constant temperature range between the first temperature and the second temperature.

The driving unit 140 drives the motor 31, and the first and second heaters 42*a* and 42*b* according to drive control signals of the control unit 130.

Hereinafter, an operating process and effects of a clothes dryer and a control method thereof in accordance with one embodiment will be described in detail.

Figure 5:
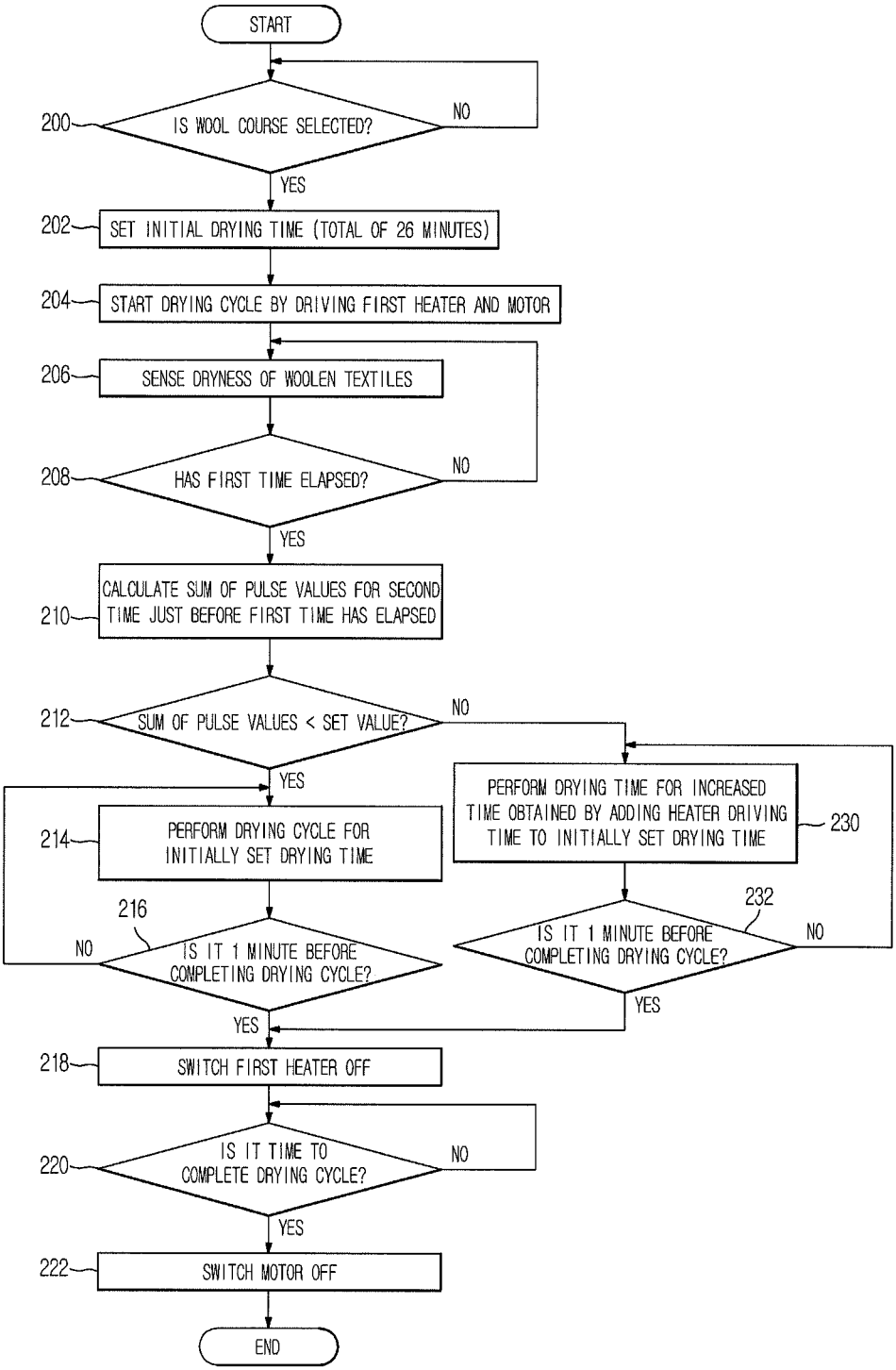
FIG. 5 is a flow chart illustrating a control algorithm of a drying cycle of a wool course in the clothes dryer in accordance with the embodiment.

FIG. 5 is a flow chart illustrating a control algorithm of a drying cycle of a wool course in the clothes dryer in accordance with the embodiment.

With reference to FIG. 5, when a user select the wool course under the condition that laundry in a wet state having completed washing, i.e., laundry to be dried (concretely, woolen textiles) is put into the rotary drum 20, course data selected by the user are input to the control unit 130 through the input unit 120.

Then, the control unit 130 judges whether the course selected by the user is the wool course based on the course data input from the input unit 120 (operation 200).

As a result of the judgment of operation 200, if the course selected by the user is the wool course, the control unit 130 initially sets a drying time to perform the drying cycle of the wool course to 26 minutes (a heater driving time obtained by subtracting the cooling time of 1 minute from the total drying time) (operation 202). The drying time of 26 minutes is an initially set time for the drying cycle of the wool course.

When the drying time is set, the control unit 130 starts the drying cycle of the wool course by driving the motor 31 through the driving unit 140 and driving the high-capacity first heater 42*a* to supply hot air of a high flow rate (operation 204).

When the drying cycle of the wool course is started, the circulation fan 43 is rotated by the motor 31 and thus generates an air flow, and the first heater 42*a* heats air passing through the heating duct 41. The air heated by the heating duct 41 is introduced into the rotary drum 20 through the hot air introduction holes 22, and removes moisture from the laundry to be dried (the woolen textiles) placed in the rotary drum 20, thereby drying the laundry (the woolen textiles). Here, the driving force of the motor 31 is transmitted to the rotary drum 20 through the belt 33, and thus the rotary drum 20 is rotated. Thereby, the laundry (the woolen textiles) within the rotary drum 20 is tumbled and thus is uniformly dried.

Further, the cooling fan 63 is rotated by the motor 31, and thus the outdoor air is sucked into the main body 10 through the suction holes 17 and is guided to the condenser 50 through the channels 61 and 62 formed on the base assembly 70. While the relatively low-temperature outdoor air guided to the condenser 50 passes through the cooling channels 51*b* of the condenser 50, the outdoor air cools the hot air passing through the condensation channels 51*a* of the condenser 50, and then is discharged to the outside through the discharge holes 18 (with reference to FIG. 1) formed through the main body 10.

While performing the drying cycle of the wool course, the laundry (the woolen textiles) within the rotary drum 20 starts to be dried. The dryness sensor 100 senses a dryness of the laundry (the woolen textiles) varied during the drying cycle, and inputs the dryness to the control unit 130 (operation 206).

Here, the dryness sensor 100 outputs a pulse value generated by converting the dryness of the laundry into an electrical signal due to contact with the laundry (the woolen textiles).

Thereafter, the control unit 130 judges whether the first time (about 10 minutes; a drying time to judge wool content of the woolen textiles) from the start of the drying cycle has elapsed (operation 208). As a result of operation 208, if the first time from the start of the drying cycle has not elapsed, the control unit 130 is fed back to operation 206, and thus outputs the pulse signal generated by converting the dryness of the woolen textiles into the electrical signal using the dryness sensor 100.

As the result of operation 208, if the first time from the start of the drying cycle has elapsed, the sum of pulse values generated by converting the dryness of the woolen textiles into electrical signals for the second time (about 5 minutes; a reference time to judge the wool content of the woolen textiles) just before the first time has elapsed (operation 210).

Thereafter, the control unit 130 compares the calculated sum of the pulse values with a set value (for example, 15; the sum of reference pulse values to discriminate wool content which is an important factor influencing the contraction rate of the woolen textiles) (operation 212). As a result of operation 212, if the calculated sum of the pulse values is not more than the set value, the control unit 130 judges that the woolen textiles have a low wool content, and thus performs the drying cycle for the initially set drying time (26 minutes) (operation 214).

Thereafter, while performing the drying cycle for the initially set drying time (26 minutes), the control unit 130 judges whether it is 1 minute before completing the drying cycle (whether the driving time of the first heater, obtained by subtracting the cooling time of 1 minute from the total drying time of 27 minutes, i.e., 26 minutes from the start of the drying cycle, has elapsed) (operation 216).

As a result of operation 216, if it is not 1 minute before completing the drying cycle, the control unit 130 is fed back to operation 214 and then performs subsequent operations.

On the other hand, as the result of operation 216, if it is 1 minute before completing the drying cycle, the control unit 130 stops the operation of the first heater 42*a* through the driving unit 140 (operation 218).

When the first heater 42*a* is switched off, the control unit 130 operates only the motor 31 for 1 minute (a cooling time)

to cool the laundry (the woolen textiles) completing drying, and then judges whether it is time to complete the drying cycle (operation 220). As a result of operation 220, if it is time to complete the drying cycle, the control unit 130 stops the operation of the motor 31 to complete the drying cycle (operation 222).

On the other hand, as the result of operation 212, if the calculated sum of the pulse values is more than the set value, the control unit 130 judges that the woolen textiles have a high wool content, and thus performs the drying cycle for an increased drying time (a total of 43 minutes) obtained by adding a heater driving time (about 17 minutes) to the initially set drying time (26 minutes) (operation 230).

Thereafter, while performing the drying cycle for the increased drying time (the total of 43 minutes), the control unit 130 judges whether it is 1 minute before completing the drying cycle (whether or not the driving time of the first heater, obtained by subtracting the cooling time of 1 minute from the total drying time of 43 minutes, i.e., 42 minutes from the start of the drying cycle, has elapsed) (operation 232).

As a result of operation 232, if it is not 1 minute before completing the drying cycle, the control unit 130 is fed back to operation 230, and then performs subsequent operations.

On the other hand, as the result of operation 232, if it is 1 minute before completing the drying cycle, the control unit 130 stops the operation of the first heater 42*a* through the driving unit 140 (operation 218), and then performs subsequent operations.

As described above, the dryness of woolen textiles is sensed using the dryness sensor 100 while performing the drying cycle of the cool course, and the drying time is adjusted by judging the wool content of the woolen textiles through the sensing of the dryness of the woolen textiles, thereby minimizing contraction or deformation of the woolen textiles while satisfying the range of a target dryness (within about 6%) set by wool mark standards.

Further, in accordance with another embodiment, a selection button to enable a user to select a drying time by hand is provided on the input unit 120. For example, the selection button is provided in a dial type such that the user may select 30 minutes, 35 minutes, etc., as the drying time, out of a range from a maximum of 43 minutes to a minimum of 26 minutes. The dryness sensor 100 senses a dryness of woolen textiles while performing the drying cycle of the wool course for the drying time selected by the user by driving the high-capacity first heater 42*a*, and the control unit 130 controls the dryness of the woolen textiles sensed by the dryness sensor 100 to be more than the target dryness (within about 6%). Further, when the dryness of the woolen textiles reaches the target dryness (within about 6%) before the drying time selected by the user has not elapsed, the operation of the first heater 42*a* is stopped, and the drying cycle of the wool course is performed only through cooling for the remaining time until the drying time selected by the user has elapsed.

As is apparent from the above description, in a clothes dryer and a control method thereof in accordance with one embodiment, wool content of woolen textiles is judged by sensing a dryness of the woolen textiles during a drying cycle of a wool course, and a drying time is adjusted according to the wool content, thereby minimizing contraction of the woolen textiles or deformation of the woolen textiles due to heat while satisfying the range of a target dryness set by wool mark standards.

Further, only a high-capacity heater is driven during the drying cycle of the wool course, thereby allowing an internal temperature of a rotary drum to keep the optimum temperature without contraction or deformation of the woolen textiles.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A control method of a clothes dryer which has a drum to receive laundry to be dried, and heaters to supply hot air to the inside of the drum, comprising:

judging whether a drying cycle is selected;

sensing a dryness of the laundry, if the drying cycle is selected; and adjusting a drying time of the laundry according to the sensed dryness, wherein in the adjustment of the drying time, the sum of pulse values for a designated time is calculated, and compares the calculated sum of the pulse values with a set value, and adjusts the drying time based on a result of the comparison.

2. A control method of a clothes dryer which has a drum to receive laundry to be dried, and heaters to supply hot air to the inside of the drum, comprising:

judging whether a drying cycle is selected;

sensing a dryness of the laundry, if the drying cycle is selected; and adjusting a drying time of the laundry according to the sensed dryness, wherein in the sensing of the dryness of the laundry, the dryness of the laundry is sensed using a pulse value generated by converting the dryness of the laundry into an electrical pulse signal while performing the drying cycle.

3. The control method according to claim 2, wherein in the adjustment of the drying time, the sum of pulse values for a designated time is calculated, and if the calculated sum of the pulse values is not more than a set value, the drying cycle is performed for an initially set drying time.

4. The control method according to claim 2, wherein in the adjustment of the drying time, the sum of pulse values for a designated time is calculated, and if the calculated sum of the pulse values is more than a set value, the drying cycle is performed for an increased time obtained by adding a heater driving time to an initially set drying time.

5. The control method according to claim 4, wherein in the adjustment of the drying time, the drying cycle is performed by varying the heater driving time according to the calculated sum of the pulse values.

* * * * *